United States Patent [19]

Czerner

[11] 4,001,933

[45] Jan. 11, 1977

[54] CUTTER DRIVE ARRANGEMENT FOR AN ELECTRIC DRY SHAVER

[75] Inventor: Peter A. Czerner, Trumbull, Conn.

[73] Assignee: Sperry Rand Corporation, Bridgeport, Conn.

[22] Filed: June 4, 1975

[21] Appl. No.: 583,612

[52] U.S. Cl. ..... 30/43.92

[51] Int. Cl.[2] ..... B26B 19/02

[58] Field of Search ..... 30/43, 43.7–43.92, 30/42, 210, 272 A, 346.51

[56] References Cited

UNITED STATES PATENTS

| | | | |
|---|---|---|---|
| 2,694,251 | 11/1954 | Dupont | 30/346.51 X |
| 3,279,057 | 10/1966 | Sanders | 30/346.51 X |
| 3,319,333 | 5/1967 | Futterer | 30/43.92 |
| 3,332,146 | 7/1967 | Kratz | 30/43.92 |
| 3,624,681 | 11/1971 | Zuurveen | 30/346.51 X |
| 3,858,314 | 1/1975 | Brenneman | 30/43.92 |

FOREIGN PATENTS OR APPLICATIONS

| | | | |
|---|---|---|---|
| 1,497,921 | 10/1967 | France | 30/43.92 |

*Primary Examiner*—Gary L. Smith
*Attorney, Agent, or Firm*—Charles R. Miranda

[57] ABSTRACT

A drive assembly for a movable cutter of an electric dry shaver and which assembly includes a driven member detachably mounted on a motor operated oscillator arm. The driven member includes a rectangular plate having means supporting a plurality of cutter bars in engagement with the under surface of an outer cutter. The plate is supported on the oscillator arm by a spring urged cap member which is disposed over the oscillator arm and causes the inner cutter to be placed in cutting cooperation with the outer cutter.

12 Claims, 6 Drawing Figures

20
24
18
14
32
17
19
22
10
30
25
28
23
16
11

41
38
44
53
47
41
45
54
45
50
55
52
49
43

14
34
17
30
20
34
29
32
24
36
18
36
55
45
26
47
40
27
51
40
44
25
53
38
49
33
50
43
22
19
28
13
10
11

CUTTER DRIVE ARRANGEMENT FOR AN ELECTRIC DRY SHAVER

BACKGROUND OF THE INVENTION

This invention relates to new and useful improvements in electric dry shavers and in particular to a drive assembly for a movable inner cutter of the shaver cutter head assembly.

In electric dry shavers it is well-known to provide a cutter head assembly whereby a movable inner cutter is held in spring-biased engagement with a stationary outer cutter whereupon in movement of the inner cutter facial hairs which are combed into the cutter heat through openings in the outer cutter are sheared.

In certain electric dry shavers the outer cutter comprises a thin metallic foil which is maintained in a bowed or arcuate configuration conforming to the arcuate shape of inner cutter bars. The cutter bars engage the under surface of the foil and is spring urged into contact with the foil. In some shavers of this type the movable inner cutter is held captive within a hairpocket section provided in a recessed portion of the shaver. The hairpocket is adapted for mounting and dismounting as an assembled unit over a motor driven oscillator arm which projects from the motor compartment of the shaver housing. In other shavers of this type the cutter foil is carried by a removable or hinged hairpocket and the inner cutter is secured to the motor oscillator arm. In these shavers the hairpocket may be removed or pivoted away from the casing without disturbing the inner cutter and access thereto is gained without interfering with the positioning of the outer cutter foil.

In these shavers various means have been provided in the past for mounting the inner cutter on the oscillator arm. Although these means have met with varying degrees of success, certain problems have been encountered in providing means for permitting ready detachment of the inner cutter assembly without interfering with the spring biasing means for the inner cutter. Further means must usually be included in such an arrangement for supporting the inner cutter for linear movement upon operation of the motor.

It is an object of the present invention to provide a novel cutter drive arrangement for an electric dry shaver.

Another object is to provide novel means for mounting a movable inner cutter in an electric dry shaver in a manner whereby it may be readily detached from the motor driven oscillator arm when desired.

Another object is to provide novel interlocking means for securely holding the inner cutter in position on a motor driven oscillator arm and which interlocking means include means for readily releasing the inner cutter from the oscillator arm.

Still another object is to provide a cutter drive means which provides for omnidirectional movement of the inner cutter without interfering with the positioning of an outer cutter foil.

SUMMARY OF THE INVENTION

The present invention contemplates a novel cutter drive assembly for an electric dry shaver. One embodiment of the cutter drive assembly includes a rectangular-shaped driven plate member for supporting the inner cutter blades of a cutter head assembly. The plate is disposed over a motor driven oscillator arm and interlocking means are provided on the oscillator arm and drive plate. Spring means are located on the drive arm which engage the under surface of the driven plate to urge the plate into cutting cooperation with an outer cutter foil mounted on a support frame hinged to the hairpocket section of the electric dry shaver. The interlocking means further include means for releasing the cutter drive plate from the drive arm without releasing the spring means therefrom.

The above and other objects and advantages of the present invention will appear more fully hereinafter from the consideration of the detailed description which follows taken together with the accompanying drawing wherein one embodiment of the invention is illustrated.

DESCRIPTION OF THE PREFERRED EMBODIMENT

Figure 1:
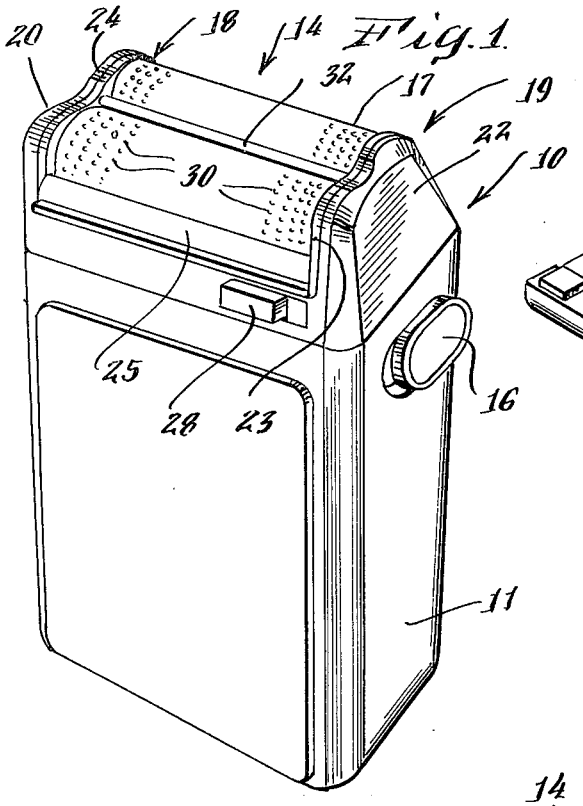
FIG. 1 is a perspective view of an electric dry shaver which incorporates one embodiment of the present invention.

Referring now to the drawings for a more detailed description of the present invention, an electric dry shaver incorporating one embodiment thereof is generally indicated by reference numeral 10 in FIG. 1. Electric dry shaver 10 is of a generally usual structure and includes a premolded main casing section 11 in which is housed an electric motor (partially shown at 13 in FIG. 3) for operating a cutter head assembly generally indicated by the reference numeral 14 (FIGS. 1 and 3) upon operation of on/off switch 16. Switch 16 controls power in a usual manner to either an external power outlet or internal battery circuit.

Figure 2:
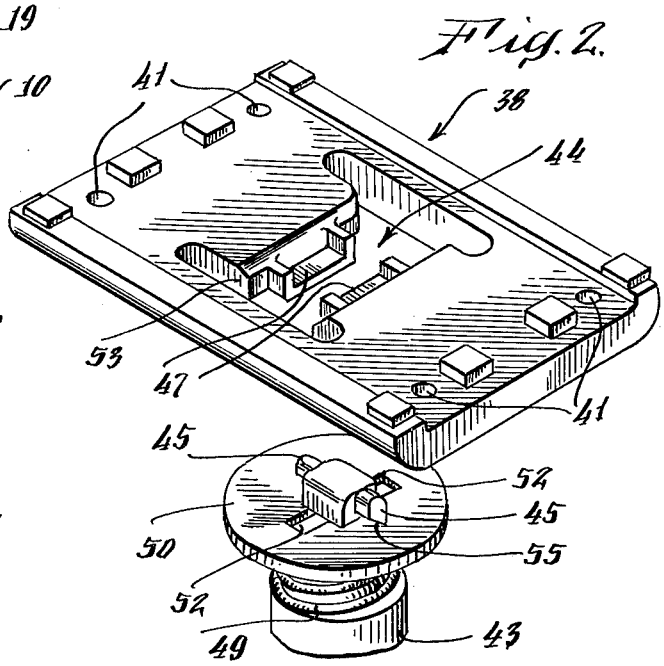
FIG. 2 is an exploded view of portions of the inner cutter supporting plate and drive means therefor.

Cutter head assembly 14 includes an outer cutter foil 17 mounted on a rectangular frame 18 disposed over a recessed hairpocket portion 19 of shaver 10 provided between end walls 20 and 22 which project upwardly from main casing 11. Foil supporting frame 18 includes end walls 23 and 24 (FIG. 1) and front and rear walls 25 and 26 (FIG. 2). Frame 18 is pivotally mounted to end pieces 20–22 as by hinge means indicated in broken lines at 27 in FIG. 3. Through releases of suitable latch means (not shown) controlled by button 28.

Outer cutter foil 17 is made by a thin flexible metallic material as suitably formed for example by an electroforming process and includes two perforated bowed portions 29–30 having hair reception slots 31. Bowed portions 29–30 are separated by a bar member 32 extending centrally of foil supporting frame 18 and are maintained in arcuate configuration by the urging of spring-biased inner cutter assembly (generally indicated by the reference numeral 33) in a manner to be hereinafter explained in detail.

Inner cutter assembly 33 comprises two spaced and parallel rows of arcuate cutter blades 34 carried by frame members 36 such as for example disclosed in U.S. Pat. No. 3,858,461 which issued on Jan. 7, 1975 to R. J. Tolmie entitled "Shaver Inner Cutter". Frame members 36 are mounted on a rectangular-shaped driven plate 38 by means of depending posts 40 press-fitted into openings 41 in plate 38 (FIGS. 2 and 3) which is formed from a premolded plastic material.

Cutter drive means comprise an oscillator arm 43 (FIG. 3) extending from main casing 11 and which arm 43 is reciprocated by motor 13 in a usual manner. In mounted position of cutter head assembly 14 on shaver 10 (FIG. 3) drive arm 43 is located within an H-shaped drive slot portion 44 of driven plate 38. The tip of arm 43 is provided with spaced inclined projections 45 which are adapted to rest on ledge portions 47 formed on the walls of slot 44 in an open position of outer cutter frame 18 (FIG. 5).

In order to bias inner cutter assembly 32 into engagement with outer cutter foil 17 an inverted conical spring 49 is disposed about drive arm 43 and is held in position thereon by a circular-shaped metallic cap member 50. Cap 50 is mounted over spring 49 on drive arm 43 by means of an enlarged opening 51 therein having cut out portions 52 (FIG. 2) conforming to projections 45 on arm 43. In mounting cap 50 cutout portions 52 are aligned with ears 43 and cap 50 is pressed down on arm 43 and rotated slightly to position cutouts 52 clear of projections 45. In this position (FIG. 5) release of cap 50 cause a spring 49 to lock cap 50 against projection 45.

In closed position of frame 18 relative to hairpocket 19 (FIG. 3) inner cutter assembly 32 is pressed downwardly on spring 49 and projection 45 are raised clear of ledges 47 as drive arm 43 engages the walls of slot 44 in position to drive inner cutter assembly 32.

Figure 3:
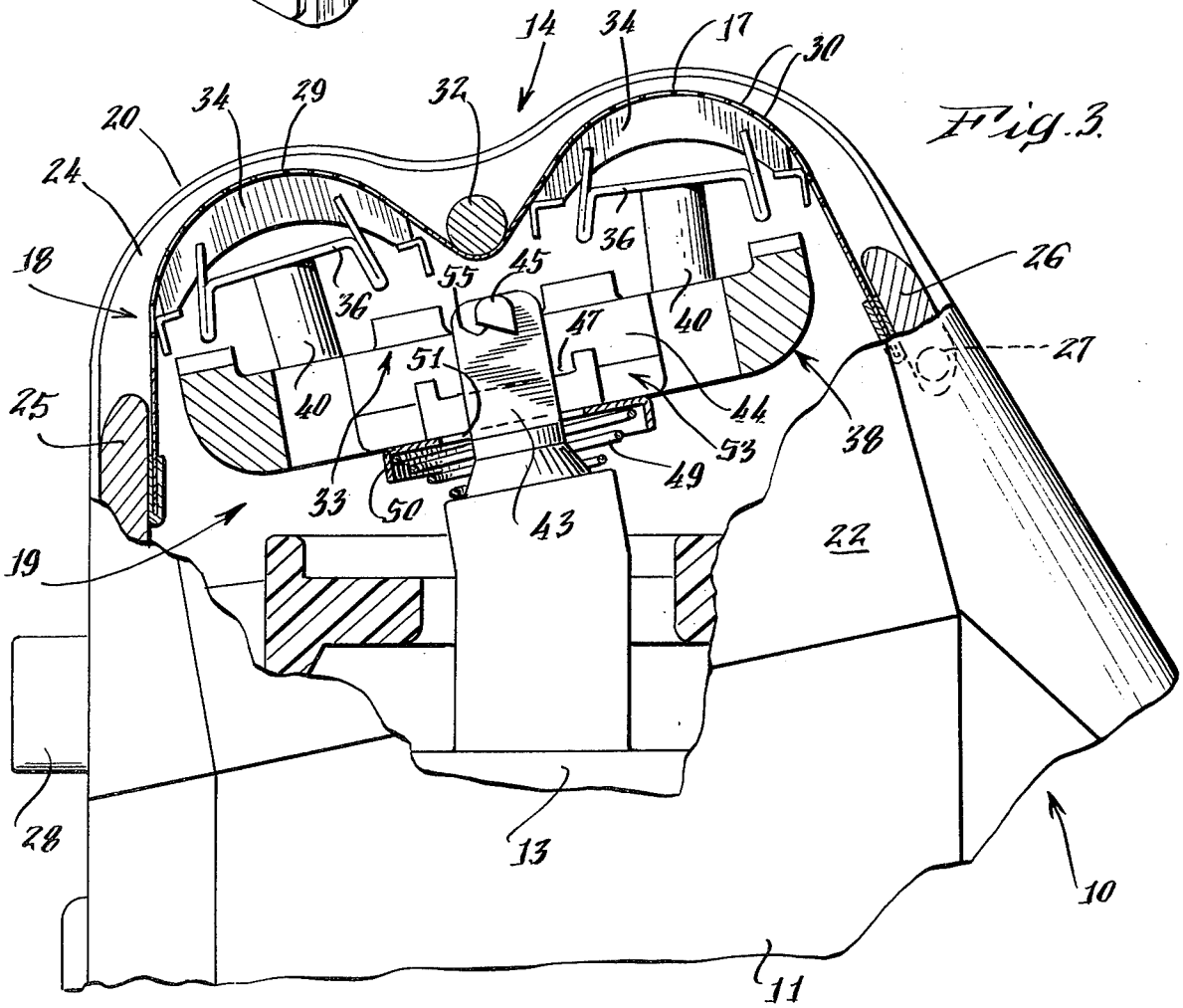
FIG. 3 is a cross-sectional view taken through the upper portion of the electric dry shaver of FIG. 1.
Figure 4:
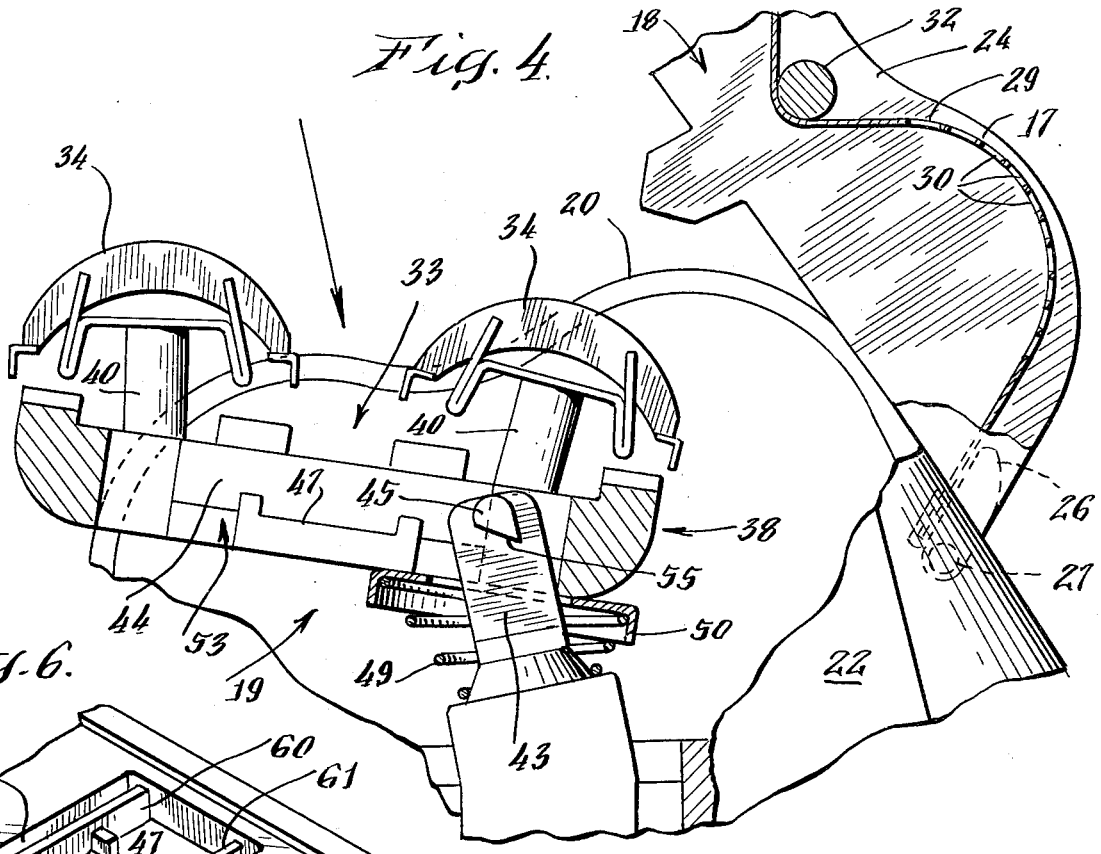
FIG. 4 is an end view of the upper portion of the shaver of FIG. 3 with parts broken away to show the inner cutter assembly in an intermediate position prior to mounting on the motor driven oscillator arm.
Figure 5:
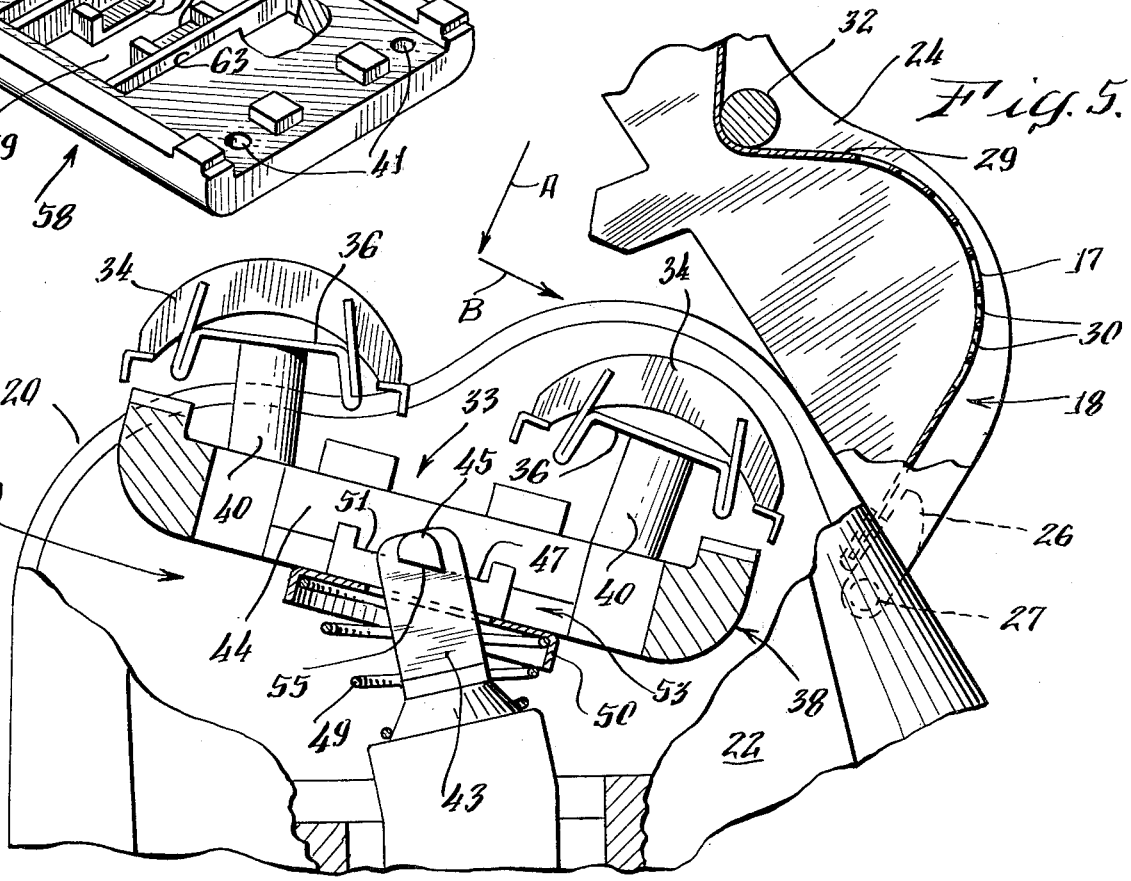
FIG. 5 is a view simlar to FIG. 4 showing the inner cutter assembly in mounted position with the outer cutter pivoted to open position.

If it is desired to remove inner cutter assembly 32 from drive arm 43 from the position shown in FIG. 3 then frame 18 is first pivoted to an open position as seen in FIG. 5 whereat spring 49 urges inner cutter assembly upwardly until cap 50 engages ears 45 on drive arm 43. Inner cutter head assembly 32 is then pressed downwardly manually on both cap 50 and spring 49 in the direction of arrow A (FIG. 5) and then slid in the direction of arrow B until projections 45 of arm 43 are moved clear of ledges 47 to the enlarged rear area 53 of slot 44 to the position shown in FIG. 4. In this position inner cutter assembly 32 is readily released from drive arm 43 since the enlarged area 53 permits the plate to pass over projection 45 on arm 43.

In released position of inner cutter 32 cap 50 and spring 49 are held captive on arm 43 by the engagement of projections 45 with cap 50 (FIG. 2).

If it is desired to remount inner cutter assembly 32 to drive arm 43 then a reverse procedure is followed by simply placing opening 53 of slot 44 of plate 38 on drive arm 43 and pressing downward and sliding the inner cutter assembly 32 in the direction opposite to arrow B until ears 45 are located in recessed ledge portions 47. Inner cutter assembly 32 is then released to allow the spring action of coil spring 49 to maintain cap 50 and drive arm 43 locked to plate 38 in the manner previously described. It will be appreciated that by providing ears 45 with inclined undersurfaces 55 allows for easier insertion of slot 44 onto arm 43. In addition as seen in FIG. 5 in open position of frame 18 inner cutter assembly 32 is held at angle relative thereto so as not to interfere with the pivotal movement of the frame.

In mounted position inner cutter assembly 32 is adjacent for omnidirectional movement about arm 43. In engagement with outer cutter foil 17 cutter 32 is thereby provided with increased freedom of movement increasing the efficiency of the shaving operation.

Figure 6:
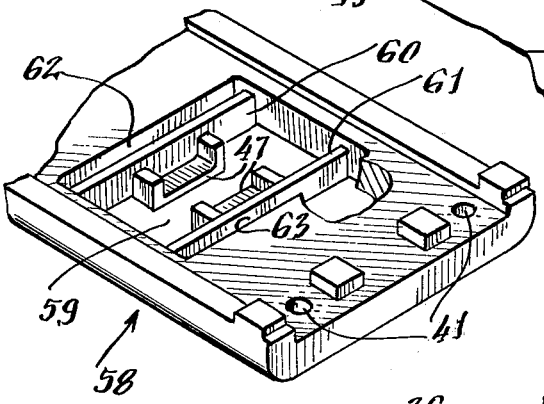
FIG. 6 is a perspective view of another embodiment of the inner cutter supporting plate.

In FIG. 6 is shown another embodiment of the drive plate designated at 58. In this embodiment the H-shaped drive slot 59 is formed by spaced bars 50–61 adjacent openings 52–63. In this manner as drive arm 43 drives plate 58 a desired frequency of vibration is established by the flexing of bars 60–61 which reduces the vibrations transmitted to casing 11 in operation of shaver 10.

It will be apparent from the foregoing description that the novel drive assembly and mounting means therefore has many advantages in use. One advantage is that a relatively uncomplex structure is provided for mounting the inner cutter assembly to the drive arm. The assembly may be easily removed from the drive arm without disturbing the spring biasing means or other mechanisims within shaver 10.

Although two embodiments of the present invention have been illustrated and described in detail, it is to be expressly undertood that the invention is not limited thereto. Various changes can be made in the design and arrangement of parts without departing from the spirit and scope of the invention as the same will now be understood by those skilled in the art.

What is claimed is:

1. An inner cutter drive assembly for an electric dry shaver having cutter drive means for operating an inner cutter relative to an outer cutter, said assembly comprising, a. a motor driving arm carrying projections thereon;

b. a driven plate member for carrying the inner cutter and adapted for engagement with said driving arm to be driven thereby;

c. spring means disposed on said driving arm and operable to urge the plate member in a direction to resiliently maintain the inner cutter in engagement with the outer cutter;

d. a slot formed in the plate member for slidably receiving the driving arm, the walls of the slot being shaped and dimensioned to prevent rotation of the arm therein; and e. ledges formed in the walls of the slot for engaging said driving arm to effect driven movement of the plate member, said ledges further being formed to seat the projections of the driving arm thereon to interlock the plate member thereto.

2. The drive assembly of claim 1 wherein said driving arm has driving portions in engagement with the walls of said slot to drive said inner cutter while in engagement with said outer cutter and wherein said projections are formed on said driving arm spaced from said driving portions.

3. The drive assembly of claim 1 wherein said plate member is slidable on said driving arm from a driving central portion of said slot to an enlarged area of said slot for release from said driving arm.

4. The drive assembly of claim 3 wherein said slot includes an H-shaped opening having the ledges provided centrally thereof.

5. The drive assembly of claim 4 wherein spaced openings are provided adjacent said H-shaped slot to form flexing of the walls of said slot upon operation of the inner cutter assembly.

6. The drive assembly of claim 1 wherein a cap member is fitted over said spring means in engagement with the plate member and said cap member include means in cooperation with said projections for selectively preventing release of said spring means from said driving arm.

7. In an electric dry shaver, a. a casing having wall portions defining a recessed portion in said casing;

b. an outer cutter member detachably mounted over said recessed portion;

c. an inner cutter assembly arranged within said recessed portion;

d. cutter drive means in said casing and including a motor driven drive arm extending into said recessed portion carrying projections thereon;

e. a driven plate member for carrying the inner cutter and adapted for engagement with the said driving arm to be driven thereby;

f. spring means disposed on said driving arm and operable to urge the plate member in a direction to resiliently maintain the inner cutter in engagement with the outer cutter;

g. a slot formed in the plate member for slidably receiving the driving arm, the walls of the slot being shaped and dimensioned to prevent rotation of the arm therein; and h. ledges formed in the walls of the slot for engaging said driving arm to effect drive movement of the plate member, said ledges further being formed to seat the projections of the driving arm thereon to interlock the plate member thereto.

8. The shaver of claim 7 wherein said projections on said driving arm prevent release of the driving arm from the plate member when said arm is in a first position within the slot, and said plate member being slidably movable to a second position to provide release of the arm from the plate member.

9. The shaver of claim 8 wherein said slot is of a general H-shaped configuration, said first drive position arranged at a mid-point within said slot and said second release position spaced from said mid-point.

10. The shaver of claim 7 wherein said ledges are provided at a mid-point of said slot for receiving said driving arm projections to prevent release of the inner cutter assembly.

11. The shaver of claim 8 wherein the spring means include a spring mounted over said driving arm, a cap member arranged on said spring for engaging said plate member, said projections preventing release of said cam member in the second release position of the plate member.

12. The shaver of claim 7 wherein spaced openings are formed in the plate member adjacent opposite walls of said slot to permit flexing of the slot walls during movement of the inner cutter assembly.

* * * * *